US009834343B2

(12) United States Patent
Beltrami

(10) Patent No.: US 9,834,343 B2
(45) Date of Patent: Dec. 5, 2017

(54) CLOSURE DEVICE WITH CUP-SHAPED VALVE FOR CONTAINERS

(71) Applicant: Artsana S.p.A., Grandate CO (IT)

(72) Inventor: Gianluca Beltrami, Grandate CO (IT)

(73) Assignee: Artsana S.p.A. (IT)

( * ) Notice: Subject to any disclaimer, the term of this patent is extended or adjusted under 35 U.S.C. 154(b) by 0 days.

(21) Appl. No.: 15/176,237

(22) Filed: Jun. 8, 2016

(65) Prior Publication Data

US 2016/0362233 A1 Dec. 15, 2016

(30) Foreign Application Priority Data

Jun. 11, 2015 (IT) ..... 102015000022942

(51) Int. Cl.

| | |
|---|---|
| ***B65D 47/06*** | (2006.01) |
| ***A47G 19/22*** | (2006.01) |
| ***B65D 47/20*** | (2006.01) |
| ***B65D 47/32*** | (2006.01) |

(52) U.S. Cl.

CPC ..... *B65D 47/06* (2013.01); *A47G 19/2272* (2013.01); *B65D 47/2018* (2013.01); *B65D 47/32* (2013.01)

(58) Field of Classification Search

CPC ..... B65D 47/06; B65D 47/12; B65D 47/122; B65D 47/2018; B65D 47/2031; B65D 47/32; B65D 51/1644; B65D 51/1633; B65D 51/16; A47G 19/2272; A47G 19/2266; A47G 19/2205

USPC .... 220/203.12, 203.11, 203.01, 203.19, 212, 220/714, 711, 367.1; 215/311, 307, 310, 215/228; 222/568, 567, 566, 547, 545, 222/544; 251/268; 277/647, 644, 637, 277/628

See application file for complete search history.

(56) References Cited

U.S. PATENT DOCUMENTS

| | | | | |
|---|---|---|---|---|
| 4,739,906 | A | 4/1988 | LoTurco | |
| 5,706,973 | A * | 1/1998 | Robbins, III | A47G 19/2272 137/588 |
| 6,758,364 | B1 | 7/2004 | Rohrig | |
| 2001/0020623 | A1 * | 9/2001 | McDonough | A47G 19/2272 220/714 |
| 2005/0205589 | A1 | 9/2005 | Davis et al. | |
| 2007/0051755 | A1 | 3/2007 | Foster et al. | |
| 2009/0020544 | A1 | 1/2009 | Yuen | |

(Continued)

OTHER PUBLICATIONS

Patent Search Results dated Jan. 27, 2016 from the Italian Patent Office on priority application 1020150022942.

*Primary Examiner* — Robert J Hicks

(74) *Attorney, Agent, or Firm* — Adam K. Sacharoff; Much Shelist, P.C.

(57) ABSTRACT

A closure device for containers comprises a lid having a spout (4) with holes (4*a*), a valve body (9) attached to the lid (4) and operable on the spout (4). The valve body (9) comprises a cup-shaped element (10) having a blind bottom wall (10*a*) and a side wall (10*b*) that emerges from the bottom wall (10*a*) and delimits an upper opening, the side wall (10*b*) of the cup-shaped element (10) being made of a resilient material, and at least partially contacting a first sleeve (5) of the lid (2), which is in fluid communication with the spout (4). The side wall (10*b*) of the cup-shaped element (10) contacts the first sleeve (5) in a fluid-tight manner and moves away from the first sleeve (5) in response to a negative pressure introduced through the spout (4).

11 Claims, 4 Drawing Sheets

(56) References Cited

U.S. PATENT DOCUMENTS

| | | | | |
|---|---|---|---|---|
| 2011/0079601 | A1 | 4/2011 | Steininger | |
| 2011/0089178 | A1* | 4/2011 | Giraud | A47G 19/2272 220/367.1 |

* cited by examiner

CLOSURE DEVICE WITH CUP-SHAPED VALVE FOR CONTAINERS

TECHNICAL FIELD

The present invention relates to a closure device for containers, particularly liquid containers for use by infants and children.

BACKGROUND OF THE INVENTION

Liquid containers designed for use by infants and children comprise a receptacle that is closed at its top by a cap which is equipped with a spout in fluid communication with the interior of the receptacle, so that the infant or child can suck the liquid contained in the cup. This type of liquid containers is particularly suitable for infants and young children that cannot drink directly from a glass.

Very young children are not completely able to control their movements, and these containers are often turned upside down or shaken or part of the liquid contained therein accidentally leaks from the aforementioned spout of the lid.

Therefore, the need is felt to equip such containers with closure devices specially designed to prevent any accidental leakage of liquid from the spout, while ensuring that the infant or child can drink correctly by sucking from the spout. Prior art closure devices comprise silicone valves, operable in the lid and at the spout, which are normally closed, to close the spout in a fluid-tight manner, and can be only opened to let the fluid flow out of the spout when the child sucks from the spout and creates a negative pressure in the container.

These closure devices and particularly the aforementioned valves are often composed of many distinct parts that have to be coupled together and associated with the lid, which involves non-negligible assembly costs, as well as the drawback of requiring particular care by the user when cleaning the closure device (and hence disassembling the valves).

Therefore, the technical purpose of the present invention is to provide a closure device for containers, that can obviate the above mentioned prior art drawbacks.

Particularly, the present invention has the object of providing a closure device for container that has low assembly costs.

A further object of the present invention is to provide a closure device for containers that can be easily an effectively cleaned by a user.

SUMMARY OF THE INVENTION

The aforementioned technical purpose and objects are substantially fulfilled by a closure device with a removable internal lining that comprises the technical features as disclosed in one or more of the accompanying claims.

BRIEF DESCRIPTION OF THE FIGURES

Further features and advantages of the present invention will result more clearly from the illustrative, non-limiting description of a preferred, non-exclusive embodiment of a closure device for containers, as shown in the annexed drawings, in which.

DETAILED DESCRIPTION OF THE INVENTION

Figure 1:
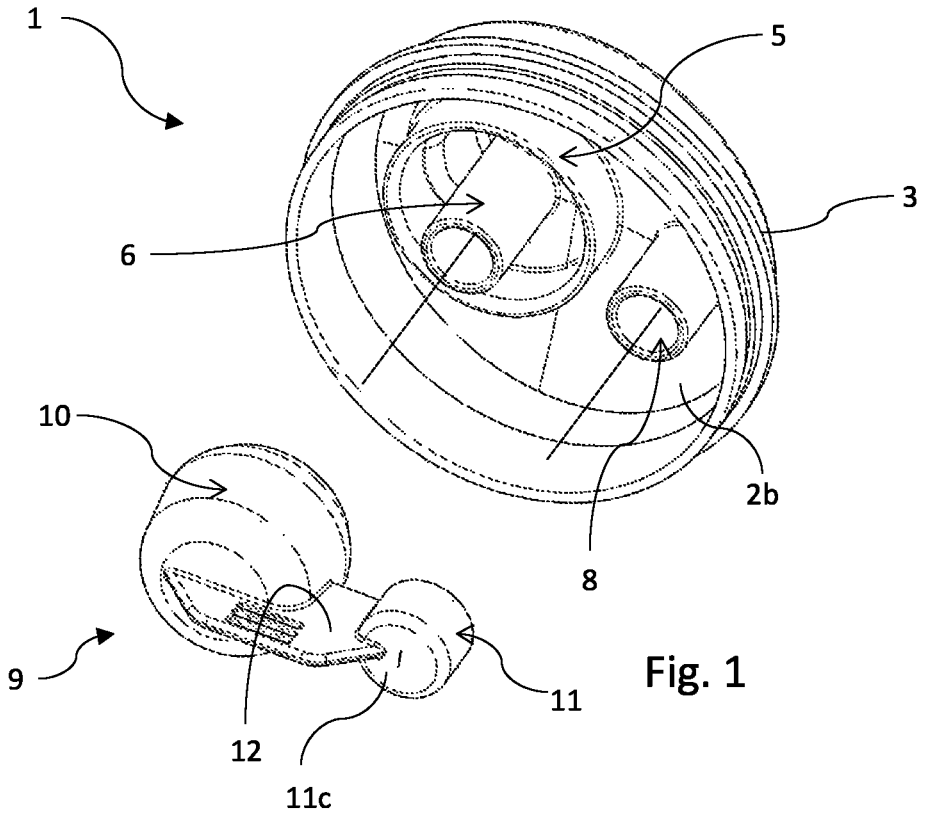
FIG. 1 is a partially exploded perspective view of a closure device for containers according to a first embodiment of the present invention.

A closure device for containers has been generally designated by numeral 1 in the annexed drawings.

The device 1 comprises a lid 2, which is designed to be coupled to a liquid container (not shown) such as a cup, a glass or the like. The lid 2 is equipped with coupling members 3 allowing it to be stably associated with the container. In the preferred embodiment of the invention, the coupling members 3 are screw threads formed on the peripheral edge of the lid 2, and designed for engagement of corresponding threads formed on the free edge of the container. In an alternative embodiment, the coupling members 3 are designed to cause the cover to be rigidly joined to the container by a mechanical interference fit. In this embodiment, the coupling members 3 comprise a seal interposed between the lid and the container.

An elongate spout 4 extends from the top surface 2*a* of the lid 2, i.e. the surface that faces away from the container, and is designed for suction by an infant or a child. The spout 4 provides fluid communication between the interior of the container and the outside environment (when the lid is mounted to the container). For this purpose, the spout is formed with at least one, preferably a plurality of holes 4*a* at its top.

Preferably, the spout 4 or at least a portion thereof is formed of one piece with the rest of the lid 2, which is made of rigid plastic. The upper part of the spout 4 can be made of a soft material, e.g. TPE.

A first sleeve 5 emerges and extends from the bottom surface 2*b* of the lid, i.e. facing away from the top surface 2*a*. The first sleeve 5 is in fluid communication with the spout 4. The first sleeve 5 has a substantially cylindrical shape and comprises an outer wall 5*a* and an inner wall 5*b* (see FIGS. 3 and 4). One end 5*c* of the first sleeve 5 is open and faces the container when the lid 2 is in use, so that the liquid in the container can reach the spout 4 (and come out of it) through the first sleeve 5. Preferably, the first sleeve 5 is formed of one piece with the lid 2. In any case, the first sleeve 5 is made of a rigid material, preferably plastic.

The open end 5*c* of the first sleeve 5 comprises an edge 5*d* that defines an opening 5*e*. The edge 5*d* has an annular extension.

A second sleeve 6 emerges and extends from the bottom surface 2*b* of the lid 2. The second sleeve 6 is not in fluid communication with the spout 4. The second sleeve 6 has a closed bottom wall (consisting of one portion of the second surface 2*b* of the lid 2), i.e. it is a blind sleeve. The second sleeve 5 also has a substantially cylindrical shape and comprises an outer wall 6*a* and an inner wall 6*b* (see FIG.

4). The end of the second sleeve 6 opposite to the blind (or closed) end is open and faces the container. The second sleeve 6 is concentric with the first sleeve 5 and is contained in the first sleeve 5, which means that one dimension thereof transverse to its longitudinal extend is smaller than the transverse dimension of the first sleeve 5. Preferably, the second sleeve 6 is formed of one piece with the lid 2. In any case, the second sleeve 6 is made of a rigid material, preferably plastic.

The lid 2 also has a vent hole 7 that extends through it from the bottom surface 2*b* to the top surface 2*a*. The vent hole 7 has the purpose of allowing the ingress of outside air into the container when the infant or child sucks from the spout to draw in liquid, to thereby restore a pressure inside the container that is equal to the pressure of the outside environment.

The lid 2 comprises a third sleeve 8 that emerges away from the bottom surface 2*b* of the lid 2. The third sleeve 8 is in fluid communication with the vent hole 7. The third sleeve 5 has a substantially cylindrical shape and comprises an outer wall and an inner wall. One end of the third sleeve 8 is open and faces the container when the lid is in use. Preferably, the third sleeve 8 is formed of one piece with the lid 2. In any case, the third sleeve 8 is made of a rigid material, preferably plastic.

The device 1 also comprises a valve body 9 attached to the lid 2 and operable at the spout 4. The valve body 9 has the purpose of preventing inadvertent leakage of liquid from the container, even when the container is turned upside down, while ensuring that the infant or child can suck from the spout 4 to drink.

Figure 3:
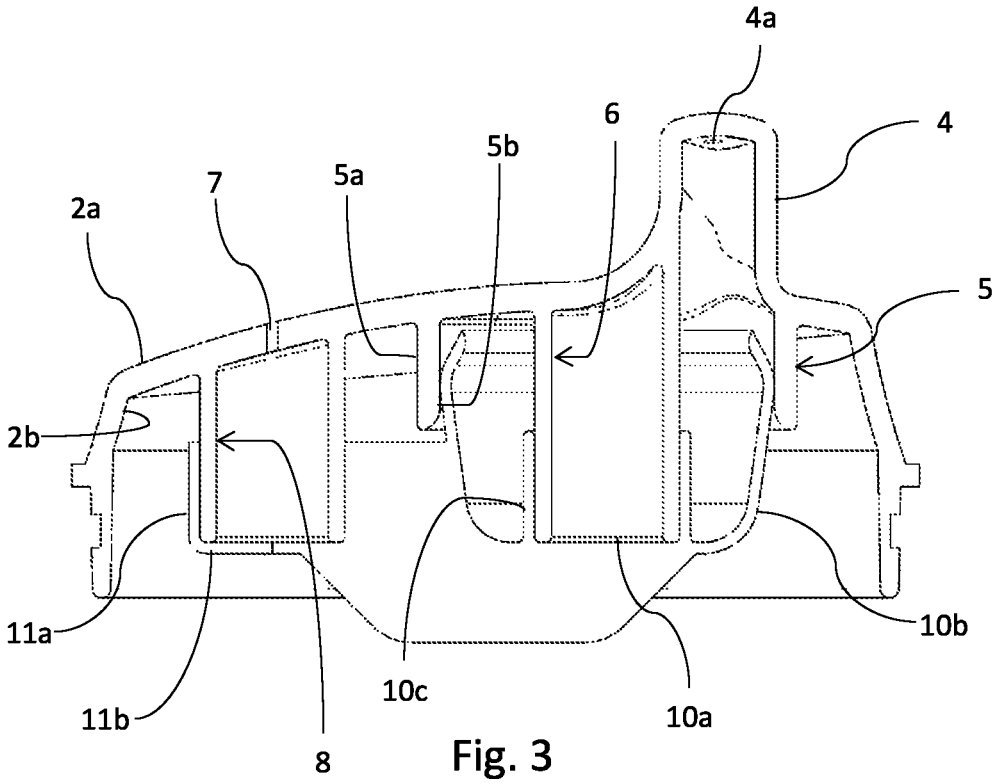
FIG. 3 is a sectional view of the closure device of FIG. 2 in the assembled state, as taken along the plane III-III.
Figure 4:
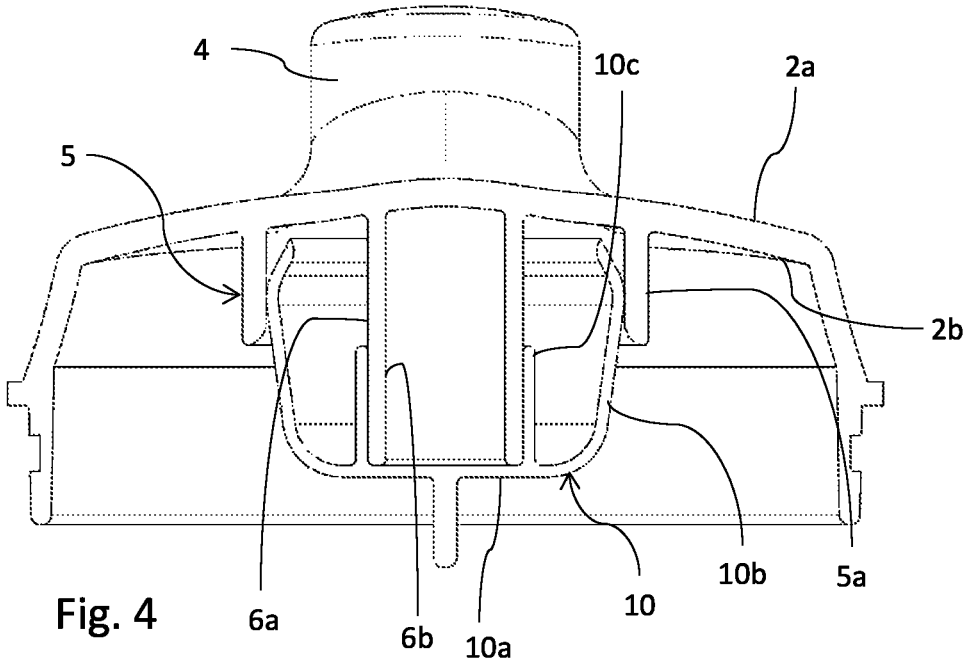
FIG. 4 is a sectional view of the closure device of FIG. 2 in the assembled state, as taken along a plane perpendicular to the plane III-III.
Figure 5:
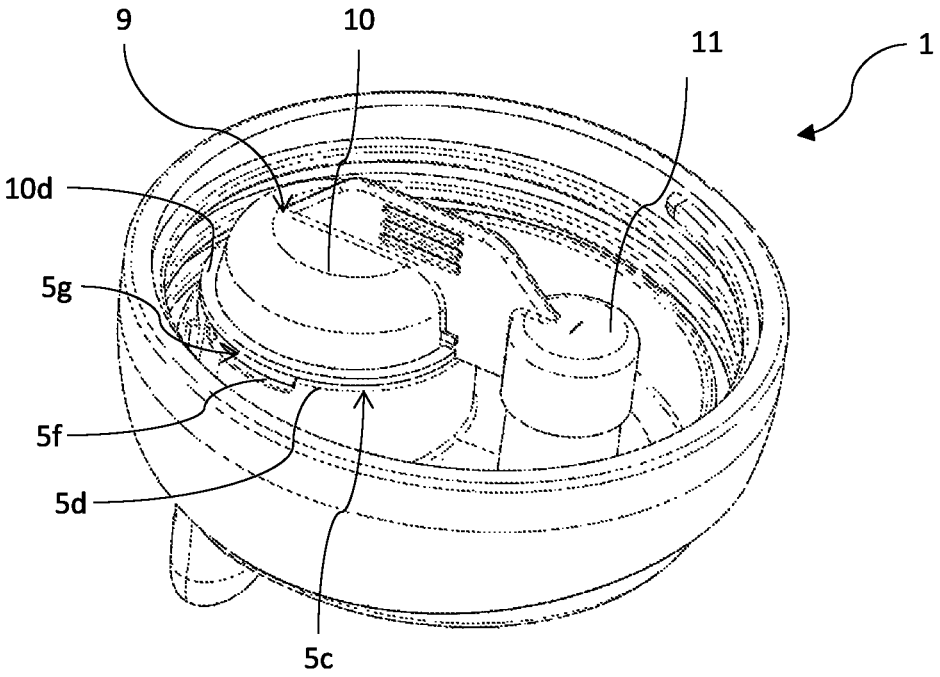
FIG. 5 is a perspective view of the closure device for containers according to a second embodiment of the present invention.
Figure 6:
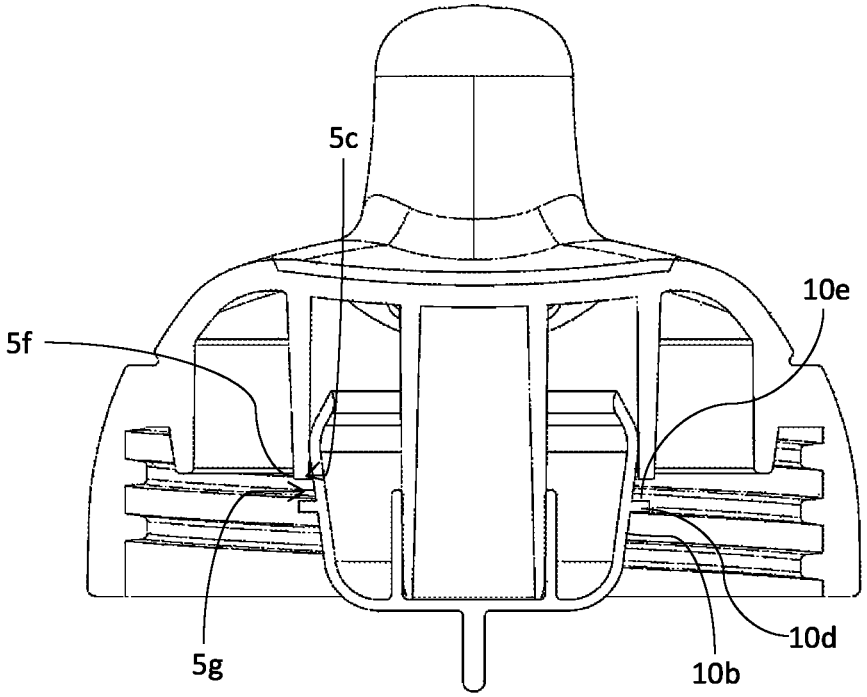
FIG. 6 is a sectional view of the closure device of FIG. 5.
Figure 7:
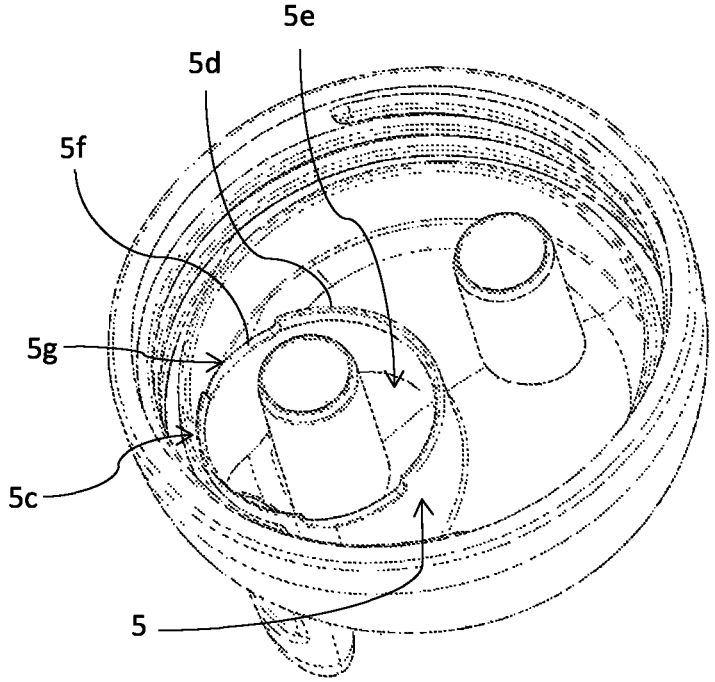
FIG. 7 is a perspective view of the closure device of FIG. 5 with the valve removed.
Figure 8:
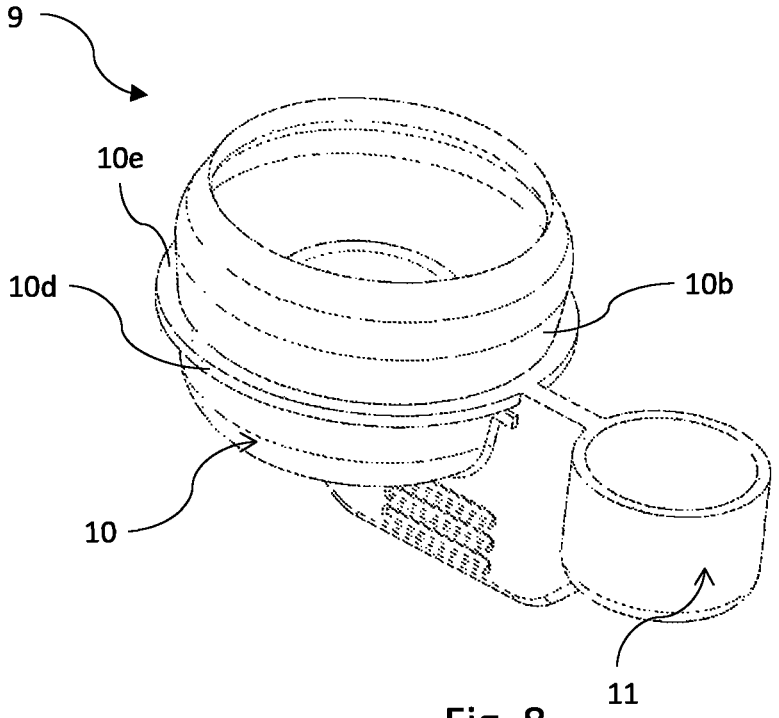
FIG. 8 is a perspective view of the valve of the closure device of FIG. 5.

Advantageously, the valve body 9 comprises a cup-shaped element 10 having a blind bottom wall 10*a* and a side wall 10*b* that emerges from the bottom wall 10*a* and delimits an upper opening (see FIGS. 3 and 4). As mentioned above, the bottom wall 10*a* is closed and connected to the substantially cylindrical side wall 10*b* of the cup-shaped element. The side wall 10*b* of the cup-shaped element is formed from a resilient material and preferably of one piece with the bottom wall 10*a*. Preferably, the cup-shaped element 10 is made of a silicone material. The resiliency of the side wall 10*b* is particularly enhanced proximate to the top opening of the cup-shaped element, i.e. at the upper edge of the side wall 10*b*. Such resilience is intended in this invention as the possibility that the side wall 10*b* may be elastically deformed in response to a load applied thereto that has a component radially directed toward the center of the cup-shaped element. The value of such load (and thus the choice of the dimensions of the side wall 10*b* according to the material used to make it), i.e. the modulus of the radial component of the load that is sufficient to cause the aforementioned elastic deformation of the side wall of the cup-shaped element will be apparent to the skilled person from the description hereinafter. The side wall 10*b* of the cup-shaped element 10 contacts the first sleeve 5, so that the opening of the cup-shaped element 10 faces the spout 4 (see FIGS. 3 and 4). Thus, the cup-shaped element 10 isolates the spout 4 from the interior of the container in a fluid-tight manner. It shall be noted that fluid tightness is ensured by the contact between the side wall 10*b* of the cup-shaped element 10 and the first sleeve 5. As shown in FIGS. 3 and 4, the side wall 10*b* of the cup-shaped element 10 contacts the inner wall 5*b* of the first sleeve 5. Particularly, only an upper portion of the side wall 10*b* of the cup-shaped element partially contacts the inner wall 5*b* of the first sleeve 5, whereas a lower portion of the side wall 10*b* does not contact the first sleeve 5 and faces the interior of the container. The free edge of the side wall 10*b* of the cup-shaped element 10, i.e. the upper end of the side wall 10*b*, is bent toward the center of the first sleeve 5 so that it at least partially does not contact the inner wall 5*b* of the first sleeve 5. Thus, a negative pressure created through the spout 4 (due to the suction exerted by the infant or the child) can generate the aforementioned load (applied to the inwardly bent portion of the side wall 10*b*) that can elastically deform the side wall 10*b* and move it away from the first sleeve 5. Such movement opens a passageway between the cup-shaped element and the first sleeve 5, thereby allowing the liquid in the receptacle to reach the spout 4.

In order to maintain the cup-shaped element 10 in position, the latter further comprises a coupling wall 10*c*, substantially concentric with the side wall 10*b* and emerging from the bottom wall 10*a*. The coupling wall 10*c* is attached to the second sleeve 6. Particularly the coupling wall 10*c* encircles the second sleeve 6 over a section thereof. As shown in FIG. 3, the coupling wall 10*c* abuts the outer wall 6*a* of the second sleeve 6. The coupling wall 10*c* is formed of one piece with the cup-shaped element 10.

Figure 2:
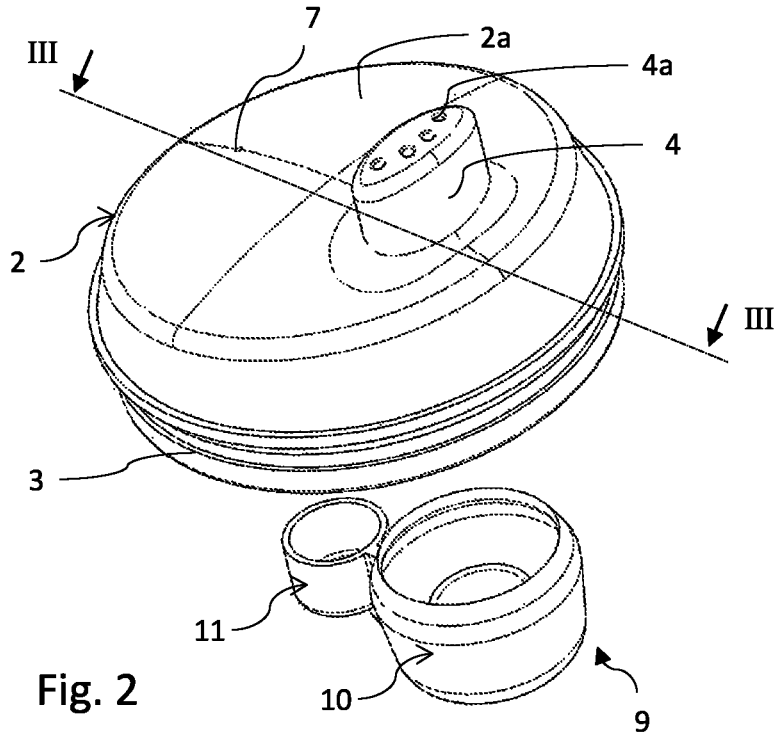
FIG. 2 is a further partially exploded view of the closure device for containers of FIG. 1.

In order to prevent accidental leakages of liquid from the venting hole 7, the device comprises a seal element 11 operable on the third sleeve 8. The seal element 11 has a cup shape (see FIG. 2). The seal element 11 comprises a side wall 11*a* that emerges from a bottom wall 11*b*. The side wall 11*a* is attached to the third sleeve 8. Particularly, the side wall 11*a* encircles the third sleeve 8 over a section thereof. As shown in FIG. 3, the coupling wall abuts the outer wall of the third sleeve 8. The bottom wall 11*b* comprises a cut 11*c* (as shown in FIG. 1) whose edges are normally in contact with each other to isolate the interior of the third sleeve 8 from the outside in a fluid-tight manner. This will isolate the venting hole 7 from the interior of the container. The edges of the cut 11*c* open apart, to create an opening, as soon as a pressure difference is created between the interior and the exterior of the third sleeve 9, i.e. between the outside environment and the interior of the container. This condition occurs, for instance, when part of the liquid in the container flows out of the spout 4. The opening formed between the edges of the cut 11*c* allows the ingress of air into the container, thereby restoring the balance between the pressure inside the container and the outside environment.

The seal element 11 is attached to the cup-shaped element 10 and is formed of one piece therewith. A bridge 12 extends between the seal element 11 and the cup-shaped element 10, with the purpose of avoiding the separation of the two elements.

The above disclosure clearly shows that the invention fulfills the intended objects.

The closure device can be simply assembled by fitting the cup-shaped element 10 onto the second sleeve 6 and the seal element 11 onto the third sleeve 8 of the lid 2. This also ensures easy disassembly and reassembly during the cleaning operations that can be carried out by the user. It shall be also noted that the lack of any undercut improves the hygiene of the device, which is a particularly advantageous feature in a device designed for use by infants and children.

In the embodiment as shown in FIGS. 5 to 8, the side wall 10*b* has an annular flange 10*d* that circumferentially extends along the side wall 10*b* and projects out of the side wall 10*b*. The annular flange 10*d* has a top surface 10*e* that faces the sleeve 5. Such top surface 10*e* abuts the edge 5*d* of the sleeve 5 over an annular portion thereof. In other words, the top surface 10*e* of the annular flange 10*d* abuts at least one annular portion of the edge 5*d* of the sleeve 5. It shall be noted that the annular top surface portion 10*e* abuts the edge

5*d* in a fluid-tight manner. The sleeve 5 has at least one recess 5*f* formed at the edge 5*d*. The recess 5*f* defines a window 5*g*, in cooperation with a portion of the top surface 10*e* of the annular flange 10*d*. Preferably, the sleeve 5 comprises two or more recesses 5*f* formed in the annular edge 5*d*. More preferably, each recess 5*f* extends substantially circumferentially along the edge 5*d*, to define, in cooperation with the annular flange 10*d*, a window 5*g* that mainly extends in the circumferential direction. This means that the window 5*g* has a greater length in the circumferential direction than in the direction transverse to the circumferential direction, and is thus configured as a slit. With the embodiment as described above, a perfect fluid tightness is ensured when no suction is exerted on the spout 4, especially if the container upon which the closure device is coupled is vigorously shaken or turned upside down. This is because the annular flange 10*d* can ensure a perfect fluid tightness in these circumstances, because the window 5*g* defined by the recess 5*f* and the annular flange 10*d* allows liquid flow only when a negative pressure is exerted on the spout 4, to a sufficient extent as to deform the side wall 10*b*, as described above. Advantageously, this embodiment maintains the above discussed operation principle, i.e. the deformation of the cup-shaped element 10 to allow liquid to flow toward the spout 4 as a result of the negative pressure created by suction. As mentioned above, the annular flange 10*d* ensures a perfect fluid tightness at the at least one contact portion with the edge 5*d* of the sleeve 5, whereas fluid is allowed to flow through the window 5*d* only as a result of suction.

The invention claimed is:

1. A closure device for containers, comprising:

a lid designed to be coupled to an opening of a container, said lid comprising a spout having holes for establishing fluid communication between the interior of the container and the outside environment, a valve body attached to said lid and operable at said spout;

said valve body comprises a cup-shaped element having a blind bottom wall and a side wall that emerges from the bottom wall and delimits an upper opening;

said side wall of the cup-shaped element being made of a resilient material, and at least partially contacting a first sleeve of said lid, which is in fluid communication with said spout, such that said opening of the cup-shaped element faces toward said holes of the spout;

said side wall of the cup-shaped element contacting said first sleeve in a fluid-tight manner and moving away from said first sleeve in response to a negative pressure introduced through said spout;

said cup-shaped element further comprising a coupling wall, substantially concentric with said side wall and rising from said bottom wall; and said coupling wall being attached to a second sleeve of said lid, located within said first sleeve, substantially concentric with said first sleeve.

2. A device as claimed in claim 1, wherein said side wall, said bottom wall and said coupling wall of the cup-shaped element form a one-piece body.

3. A device as claimed in claim 1, wherein said lid comprises a top surface and a bottom surface, said spout extending from said top surface and said first and second sleeves extending from said bottom surface.

4. A device as claimed in claim 1, wherein said side wall of the cup-shaped element is operable within said first sleeve and is elastically deformable to contact and move away from said first sleeve in response to forces applied perpendicular to the side wall itself.

5. A device as claimed in claim 4, wherein an upper portion of said side wall of the cup-shaped element at least partially contacts an inner wall of the first sleeve and a lower portion of said side wall is not contacted by said first sleeve.

6. A device as claimed in claim 5, wherein a free edge of the side wall of the cup-shaped element is bent toward the interior of the first sleeve such that it does not contact the inner wall of the first sleeve.

7. A device as claimed in claim 1, wherein said second sleeve is blind.

8. A device as claimed in claim 1, wherein said lid comprises a vent hole, said valve body comprising a seal element operable on said vent hole to open and close the latter.

9. A device as claimed in claim 8, wherein said seal element is stably connected to said cup-shaped element.

10. A device as claimed in claim 1, wherein:

said first sleeve comprises an edge defining an opening, said side wall comprises an annular flange projecting out of said side wall and having a top surface that abuts a portion of said edge in a fluid-tight manner.

11. A device as claimed in claim 10, wherein:

said first sleeve comprises at least one recess formed at said edge and defining a respective window in cooperation with a portion of said top surface of said annular flange.

* * * * *